United States Patent [19]

Lippe

[11] Patent Number: 4,644,710

[45] Date of Patent: Feb. 24, 1987

[54] LIP BLOCK CONSTRUCTION

[76] Inventor: Lloyd K. Lippe, P.O. Box 95, Seguin, Tex. 78155

[21] Appl. No.: 674,658

[22] Filed: Nov. 26, 1984

Related U.S. Application Data

[62] Division of Ser. No. 391,566, Jun. 24, 1982, Pat. No. 4,505,088.

[51] Int. Cl.[4] ..... E04B 1/32

[52] U.S. Cl. ..... 52/86; 52/227

[58] Field of Search ..... 52/248, 584, 227–229, 52/86, 89, 606, 607, 438, 582, 585, 586; 405/151

[56] References Cited

U.S. PATENT DOCUMENTS

| | | | |
|---|---|---|---|
| 722,249 | 3/1903 | Pixley | 52/585 |
| 764,580 | 7/1904 | Graves | 52/585 |
| 884,498 | 4/1908 | King | 52/89 |
| 1,004,288 | 9/1911 | McAlpine | 405/151 |
| 1,452,583 | 4/1923 | Williams | 52/582 |
| 1,783,383 | 12/1930 | Montrief | 52/584 |
| 1,968,393 | 7/1934 | Henderson | 52/438 |
| 2,275,523 | 3/1942 | Goldbeck | 52/248 |
| 2,336,228 | 12/1943 | Davey | 52/86 |
| 2,340,263 | 1/1944 | Dodson | 52/227 |
| 4,505,088 | 3/1985 | Lippe | 52/586 |

FOREIGN PATENT DOCUMENTS

| | | | |
|---|---|---|---|
| 982938 | 2/1951 | France | 52/89 |
| 257588 | 3/1928 | Italy | 52/438 |
| 93180 | 10/1920 | Switzerland | 52/607 |

*Primary Examiner*—James L. Ridgill, Jr.

*Attorney, Agent, or Firm*—James A. Bargfrede

[57] ABSTRACT

A method of assembly adapted for use with underground structures having an arcuate, elongated configuration and constructed of substantially identical blocks joined together with substantially identical fastening means and extending from both sides of a center keystone thereby allowing energy efficient, reliable, low cost structures capable of being mass produced with minimal die or pattern expense.

2 Claims, 7 Drawing Figures

LIP BLOCK CONSTRUCTION

This is a division of application Ser. No. 06/391,566 filed June 24, 1982, now U.S. Pat. No. 4,505,088 issued Mar. 19, 1985.

SUMMARY OF THE INVENTION

The present invention provides a building structure adapted for use as underground or partially undergound structures. Such building structure is of an arcuate configuration on a concrete foundation slab. The arcuate structure has a central cast concrete keystone of special construction in accordance with the present invention. The remaining blocks used for the building structure extend downwardly from the central keystone and essentially are mortarless modified concrete blocks utilized in the construction industry thereby allowing interchangeability during construction of the building structure of the present invention. Thus, the modified concrete construction blocks do not require a close tolerance but may have tolerances generally found in ordinary concrete construction blocks.

The modified concrete construction blocks are joined together with fastening means comprising elongated substantially flat, rectangular-shaped shear key members. End fastening means are provided to secure each transverse or longitudinal row of blocks and include first and second end members, each of which has a partially recessed opening for receiving a bracket member having first and second tie rods or cables connected thereto and having a threaded member extending from the bracket into such partially recessed opening.

The central keystone member of the arcuate building structure is formed by plywood which is positioned to allow concrete to be poured between the two longitudinal rows of modified concrete construction blocks at the upper portion of the arcuate construction with a steel reinforcing rod being positioned in the concrete fill prior to pouring concrete for the keystone. A pair of metal fabrication are used to provide necessary adjustment and temporary support to each transverse or longitudinal row and support the suspended plywood form. The metal fabrication have slots for two bolts and nuts to allow adjustment of the metal fabrications by movement in the elongated openings in which each of the bolt and nut assembly are positioned. When concrete is poured to become the central keystone block, the metal fabrications are cast into the concrete.

The present invention utilizes repetitive modules or blocks and a building can be constructed with relatively low-skilled labor and with minimal equipment. Because the structure is adapted for total or partially underground use, heating and cooling costs are minimal because of the inherent thermal benefits of the earth. Two factors which have presented problems in the past, moisture and weight, have been overcome through the building structure provided by the present invention and by the use of conventional waterproofing methods.

DETAILED DESCRIPTION

Figure 1:
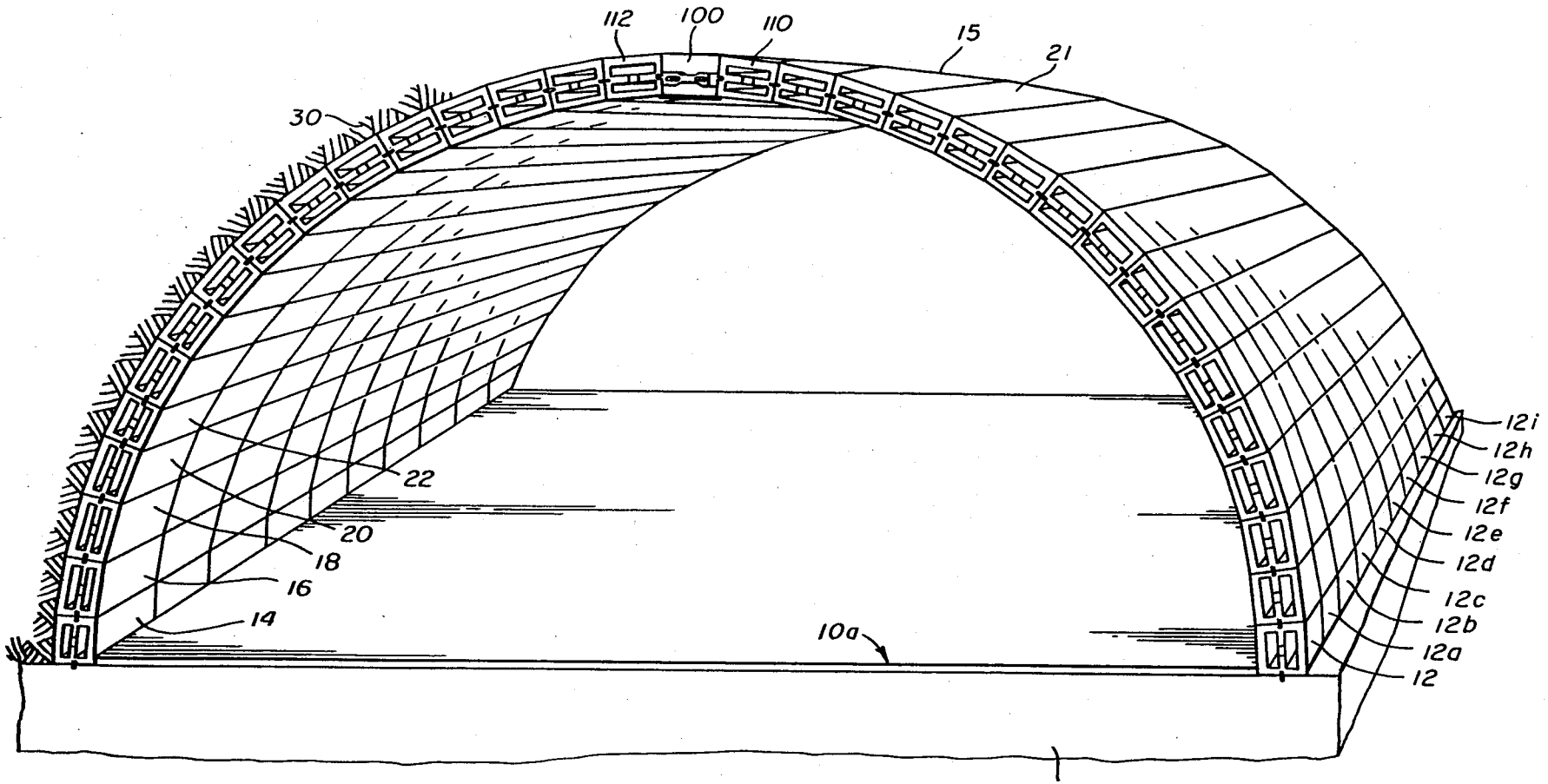
FIG. 1 is a perspective view showing the building structure of the present invention on a concrete slab and partially covered with soil.

FIG. 1 is a perspective view showing the building structure of the present invention. A concrete slab 10 may be poured in a conventional manner well-known in the construction industry to form a structural concrete slab which may be of any desired concrete specification depending upon the type of soil and other environmental conditions which may be encountered.

Positioned on the concrete slab 10 are two longitudinal rows of blocks, such as row 12 and row 14. These longitudinal rows comprise a plurality of modified concrete construction blocks such as block 12*a*, 12*b*, 12*c*, 12*d*, 12*e*, 12*f*, 12*g*, 12*h* and 12*i* thereby forming a longitudinal row along one side of the building structure having an arcuate configuration and generally identified in FIG. 1 with the reference numeral 15.

It will be appreciated by those skilled in the art to which the present invention pertains that longitudinal row 14 also comprises a plurality of the same modified concrete construction blocks to provide a base support on which additional rows of blocks such as longitudinal rows 16, 18, 20 and 22 are provided. Keystone 100 is centrally located between rows 110 and 112 and is explained in detail in connection with FIG. 6. It will be appreciated that after the connection and joining of the modified concrete construction blocks in accordance with the method of the present invention that an arcuate building structure is provided having a concrete slab and which when completed may be partially covered with soil 30 to provide natural thermal benefits inherent in the earth. Prior to placing soil 30, a second and finished slab 10*a* is poured over concrete slab 10 for the purpose of providing an adequate counterreaction of the forces of the soil at the base of the structure from pushing the first laid rows inward. The building structure of the present invention provides reduction of heating and cooling costs which are important in the present era of energy-conscious living. It will be appreciated further that the building structure is comprised of repetitive modules and may be constructed with low-skilled labor and minimal equipment, as will be explained in detail in connection with the other drawing figures.

Figure 2:
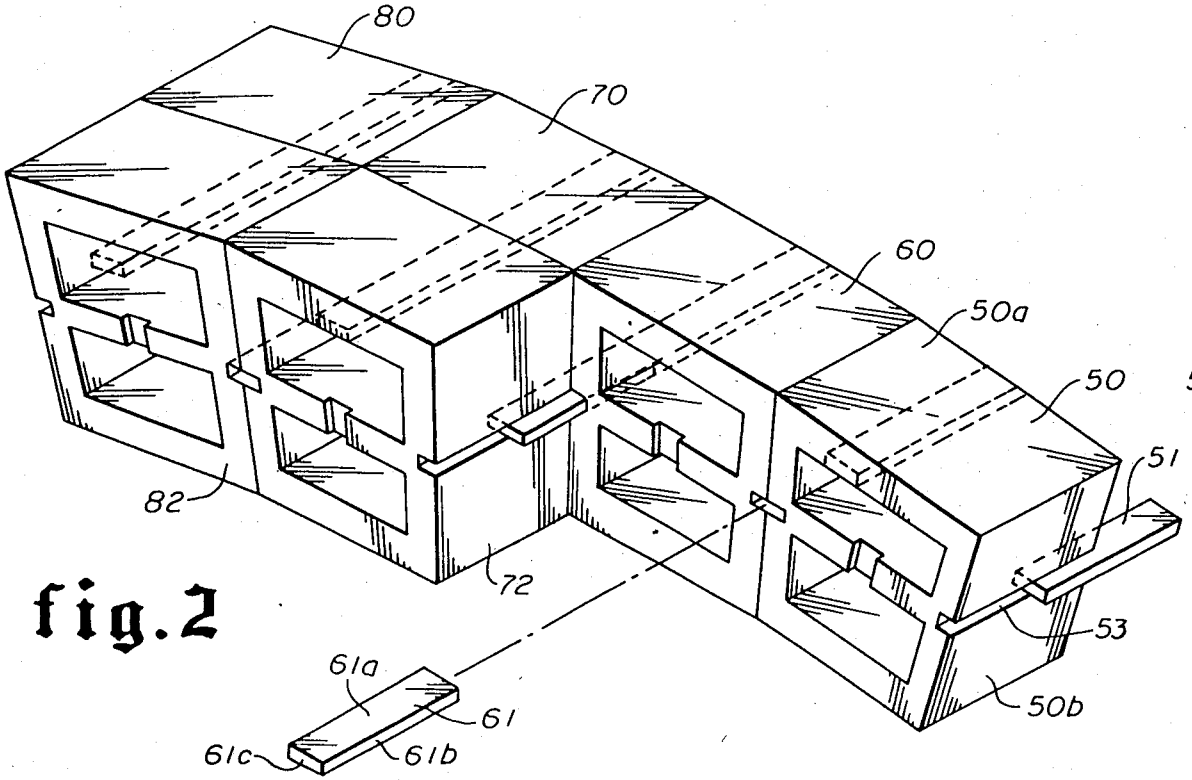
FIG. 2 is an upper, isometric or perspective view of part of the block structure shown in connection with the building structure of FIG. 1.

FIG. 2 is an upper, isometric or perspective view showing the modified concrete construction blocks utilized in construction of the building structure 15 shown in FIG. 1. A plurality of blocks, such as blocks 50, 60, 70 and 80 comprise part of the arcuate section of the building structure, block 72 and block 82 are shown positioned and connected to blocks 70 and 80.

Block 50, as explained previously, is a modified concrete construction block and fabricated in a conventional cinder block machine thereby allowing standardization and interchangeability to be practiced in constructing the building structure of the present invention. Block 50 includes a top portion 50*a*, a side portion 50*b*.

An elongated substantially flat fastening member 51 is used as a shear key and adapted for slideable engagement in slot 53 of block 50 and the block adjacent to block 50.

It will be appreciated in reviewing the disclosure of FIG. 2 that a plurality of elongated, substantially flat fastening members, such as fastening member 51, are utilized in fixedly positioning blocks 50, 60, 70 and 80 and in fixedly positioning block 70 to block 72 and block 80 to block 82. For example, elongated fastening member 61 may be used in positioning of block 50 to block 60. The elongated fastening member 61 has a top 61*a*, a side 61*b*, and an end 61*c* visible in FIG. 2. Not visible in FIG. 2 is another side, another end, and a bottom portion. The elongated fastening member 61 is typical of the elongated fastening members utilized in constructing the entire arcuate building structure of the present invention.

The easy, reliable, and relatively fast positioning of blocks of standard size and quality are an important aspect of the present invention because of minimal need for conventional construction hardware such as nails, screws, and clamps. It should be noted that an arcuate formwork will be required for the first two or three transverse rows. But after several rows are in place, the subsequent blocks are able to support off of the previous transverse row by the use of the shear key.

Figure 3:
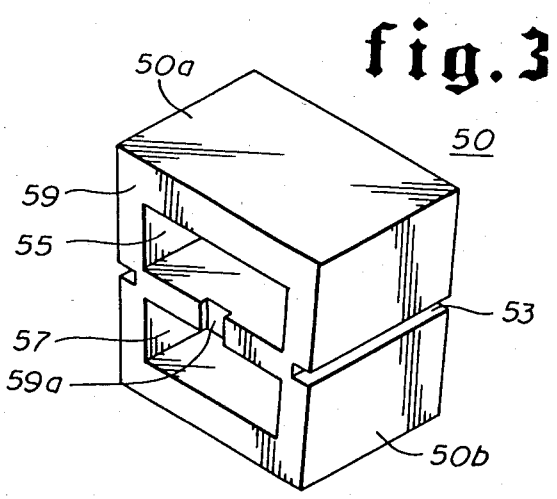
FIG. 3 is an upper, isometric or perspective view of an individual, modified concrete construction block utilized in practicing the present invention.

FIG. 3 is an upper, isometric or perspective view of an individual, modified concrete construction block, such as block 50 shown in FIG. 2. Block 50 includes a top 50*a*, a side 50*b* having a slot 53 as pointed out previously in connection with FIG. 2. Block 50 includes an upper opening 55 and a similar lower opening 57 typical of the modified concrete construction blocks and standard industry blocks. The face 59 of block 50 includes a notch 59*a*.

Figure 4:
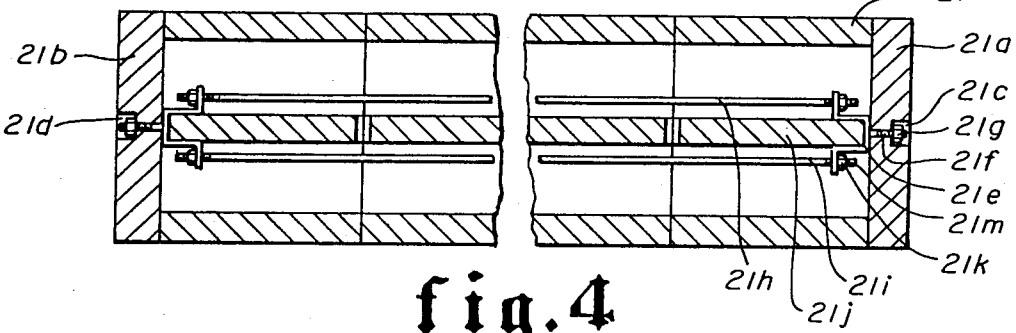
FIG. 4 is a longitudinal, sectional, elevational view showing a series of modified concrete construction blocks held together through end fastening means.

FIG. 4 is a longitudinal, sectional, elevational view showing a series of modified concrete construction blocks held together through end fastening means and in a row such as row 21 shown in FIG. 1. Row 21, for example, may have end members 21*a* and 21*b*, each of which has a recess 21*c* and 21*d* for receiving a cable or tie wire bracket such as tie wire bracket 21*e* having a threaded portion 21*f* on which is positioned a nut 21*g*. Cable or tie wire members 21*h* and 21*i* are positioned to each side of member 21*j* which is the central portion of the modified concrete construction block. The tie wires 21*h* and 21*i* have threaded ends and are secured to the bracket 21*e* with nuts in a manner well known in the construction art as shown in FIG. 4. Specifically, nut 21*k* is threadedly connected to threaded end 21*m* of tie wire 21*i*.

Figure 5:
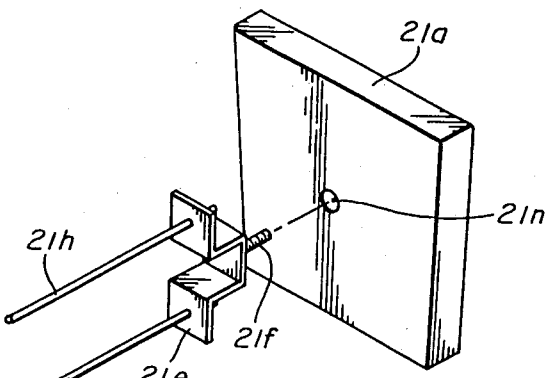
FIG. 5 is an upper, isometric or perspective view of one of the end fastening means shown in FIG. 4.

FIG. 5 is an upper, isometric or perspective view of end member 21*a* having an opening or hole 21*n* in which threaded portion 21*f* is positioned. Threaded portion 21*f* is connected to bracket 21*e* having tie wires 21*h* and 21*i*.

Figure 6:
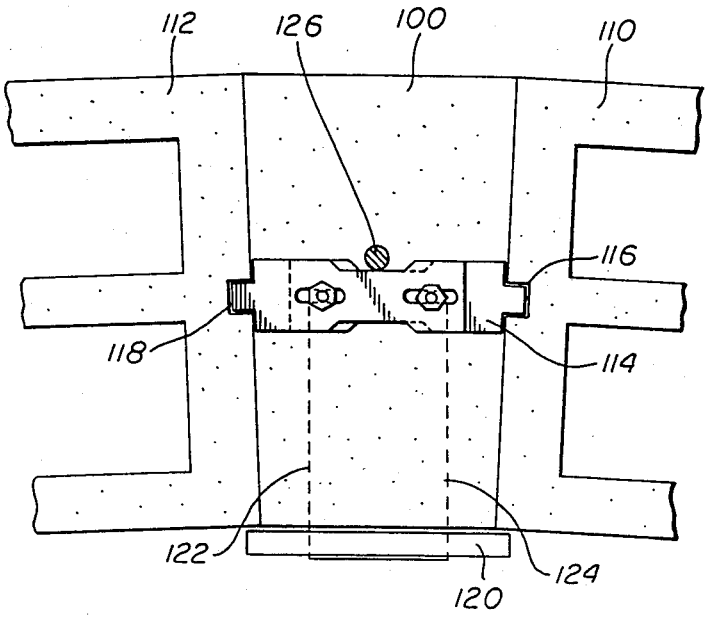
FIG. 6 is a front, transverse sectional view of the central cast concrete keystone utilized at the center and uppermost part of the building structure shown in FIG. 1.

FIG. 6 is a front, transverse sectional view of the central cast concrete keystone utilized at the center and uppermost part of the building structure shown in FIG. 1. As rows of blocks are positioned as has been described previously and the arcuate configuration develops, there ultimately will be a space left between the blocks which have been built starting from each side of the base or concrete slab. This space is filled with concrete to form a keystone member 100 positioned between block rows 110 and 112 shown in FIG. 1. It will be appreciated that rows 110 and 112 are constructed in accordance with the previously disclosed method of the present invention and when the keystone member is ready to be poured with concrete, a keystone fastening means 114 which may be called a compression bracket also is utilized and positioned in notch 116 and notch 118. A similar arrangement is provided at the top of each transverse row of blocks 12, 12*a* through 12*i*. An important part of the present invention is the keystone construction wherein keystone fastening means 114 also called compression brackets are utilized and the keystone fastening means 114 will be explained in detail subsequently in connection with the detailed description of FIG. 7.

A plywood or other material form 120 is suspended by tie wires 122 and 124 and a conventional steel reinforcing rod 126 is positioned on top of the keystone fastening means 114. Concrete then is poured in the space or opening between rows 110 and 112 and upon hardening of the concrete, the arcuate building structure is complete and structurally sound. The tiewires 122 and 124 are cut to allow the plywood form to be removed.

Figure 7:
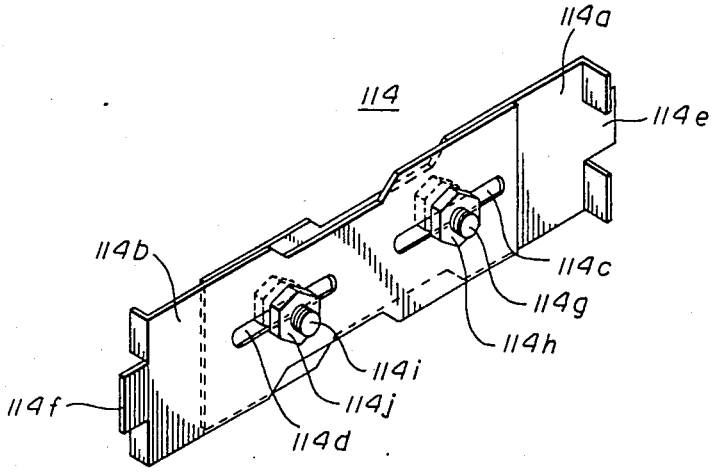
FIG. 7 is an upper, perspective view of the metal fabrication members shown in FIG. 6.

FIG. 7 is an upper, perspective view of the metal fabrication members shown in FIG. 6 and also referred to as compression brackets. Keystone fastening means 114 include identical members 114*a* and 114*b*. Each of members 114*a* and 114*b* has an elongated slot to form openings 114*c* and 114*d* when positioned as shown in FIG. 7 to allow adjustment of members 114*a* and 114*b* for engagement in the concrete block notches with lips or protrusions 114*e* and 114*f* as explained previously in connection with FIG. 6. A bolt 114*g* having a nut 114*h* positioned thereon is positioned in slot 114*c* and, likewise, bolt 114*i* having nut 114*j* is positioned in slot 114*d*. It will be appreciated in viewing the keystone fastening means shown in FIG. 7 that members 114*a* and 114*b* may be assembled quickly and adjusted to compensate for the varying distance that may be found between the notches in the blocks adjacent the keystone centerpiece. These brackets keep each half of the arcuate structure from collapsing inward until the concrete keystone is cast.

Thus, it will be appreciated that the present invention provides a new and useful method and apparatus for constructing a building structure adapted for at least partial burial whereby the natural thermal qualities of the earth are utilized to minimize heating and cooling expense when the building structure of the present invention is inhabited.

Although a preferred embodiment of the invention has been shown and described in accordance with the requirements of the United States Patent Laws, it will be appreciated by those skilled in the art to which the present invention pertains that many modifications and improvements may be made without departing from the spirit of the invention defined by the following claims. Although such claims may be presented in an indented format to facilitate reading and understanding thereof, such indented format is not to be construed as a structural or functional limitation of the elements or steps recited in such claims.

What is claimed is:

1. A concrete building block assembly for use in the construction of an arcuately shaped building, comprising (a) a plurality of building blocks, each comprising (1) top and bottom walls;

(2) a pair of planar side walls integrally connected with the side edges of said top and bottom walls, respectively, to define a chamber; and (3) an integral intermediate wall connected between said side walls for bisecting said chamber, the front and rear surfaces of said top, bottom, side and intermediate walls defining parallel planar front and rear surfaces of said block, respectively, said side walls each containing an elongated slot extending between said front and rear surfaces and arranged midway between said top and bottom walls, said slots each having spaced parallel upper and lower planar portions and a planar section arranged normal to said upper and lower planar portions, said intermediate wall front and rear surfaces each containing a recess centrally arranged between said side walls, respectively;

(b) means for connecting adjacent blocks in side-by-side relationship to define an arcuate row of blocks, said block connecting means comprising a plurality of elongated fastening members arranged in said slots of said adjacent blocks, said fastening members each having a rectangular configuration;

(c) means for connecting adjacent rows of blocks to define an arcuate structure, said row connecting means comprising tie wire brackets arranged in at least said intermediate front wall surface of one block of the first row of blocks and said intermediate rear wall surface of a corresponding block of the last row of blocks; and (d) end wall means connected with said one block front surface and with said corresponding block rear surface for closing said bisected chambers thereof, said rear wall means containing a central opening for receiving a portion of said tie wire bracket and for connecting said bracket with said end wall means, whereby said elongated fastening members and said tie wall brackets resist torsional, compression, and moment forces generated in the arcuately-shaped building.

2. Apparatus as defined in claim 1, and further comprising (e) a planar concrete slab for supporting said rows of blocks; and (f) keystone means arranged between adjacent blocks at the top portion of an arcuate row for lightening and strengthening said row of blocks.

* * * * *